US007886374B2

(12) United States Patent
Jun

(10) Patent No.: US 7,886,374 B2
(45) Date of Patent: Feb. 15, 2011

(54) PASSIVELY DISCHARGING AND WATER-SAVING TOILET BOWL

(75) Inventor: Young-Se Jun, Seoul (KR)

(73) Assignee: 3-Liter Co., Ltd. (KR)

( * ) Notice: Subject to any disclaimer, the term of this patent is extended or adjusted under 35 U.S.C. 154(b) by 1001 days.

(21) Appl. No.: 11/575,518

(22) PCT Filed: Jun. 1, 2005

(86) PCT No.: PCT/KR2005/001638

§ 371 (c)(1),
(2), (4) Date: Mar. 19, 2007

(87) PCT Pub. No.: WO2006/033515

PCT Pub. Date: Mar. 30, 2006

(65) Prior Publication Data

US 2009/0178190 A1 Jul. 16, 2009

(30) Foreign Application Priority Data

Sep. 20, 2004 (KR) ..... 1020040075132
Nov. 30, 2004 (KR) ..... 1020040099504

(51) Int. Cl.
*E03D 11/10* (2006.01)

(52) U.S. Cl. ..... 4/434; 4/324; 4/435

(58) Field of Classification Search ..... 4/324–326, 4/413–415, 405, 434, 435
See application file for complete search history.

(56) References Cited

U.S. PATENT DOCUMENTS 173,760 A * 2/1876 Blunt ..... 4/434
3,972,076 A 8/1976 Martini
4,219,895 A * 9/1980 Thompson ..... 4/325

FOREIGN PATENT DOCUMENTS

EP 1045077 A1 10/2000
JP 05083077 11/1993
KR 20010237149 6/2001
KR 20030308696 3/2003

OTHER PUBLICATIONS

International Search Report; PCT/KR2005/001638; Sep. 12, 2005.

* cited by examiner

*Primary Examiner*—Tuan N Nguyen
(74) *Attorney, Agent, or Firm*—Cantor Colburn LLP

(57) ABSTRACT

Disclosed herein is a passively discharging and water-saving toilet bowl having an operation mechanism in which all parts are accurately operated as well as a water supply controlling mechanism by which the water level in a water reservoir can be controlled arbitrarily. The toilet bowl, having an operation mechanism conducted with an operation unit comprising: a first operation unit, operated with a manipulation lever, communicating both with a stool-discharging piston for opening or closing a stool-discharging pipe and with a flap valve for opening or closing a water reservoir; and a second operation unit, operating in response to the position of a float for controlling the water level of the water reservoir in such a manner that the second operation unit is connected to and separated from the first operation unit when the float is situated at an upper position and a lower position, respectively.

18 Claims, 21 Drawing Sheets

Prior Art

Prior Art

Prior Art

[Fig. 4]
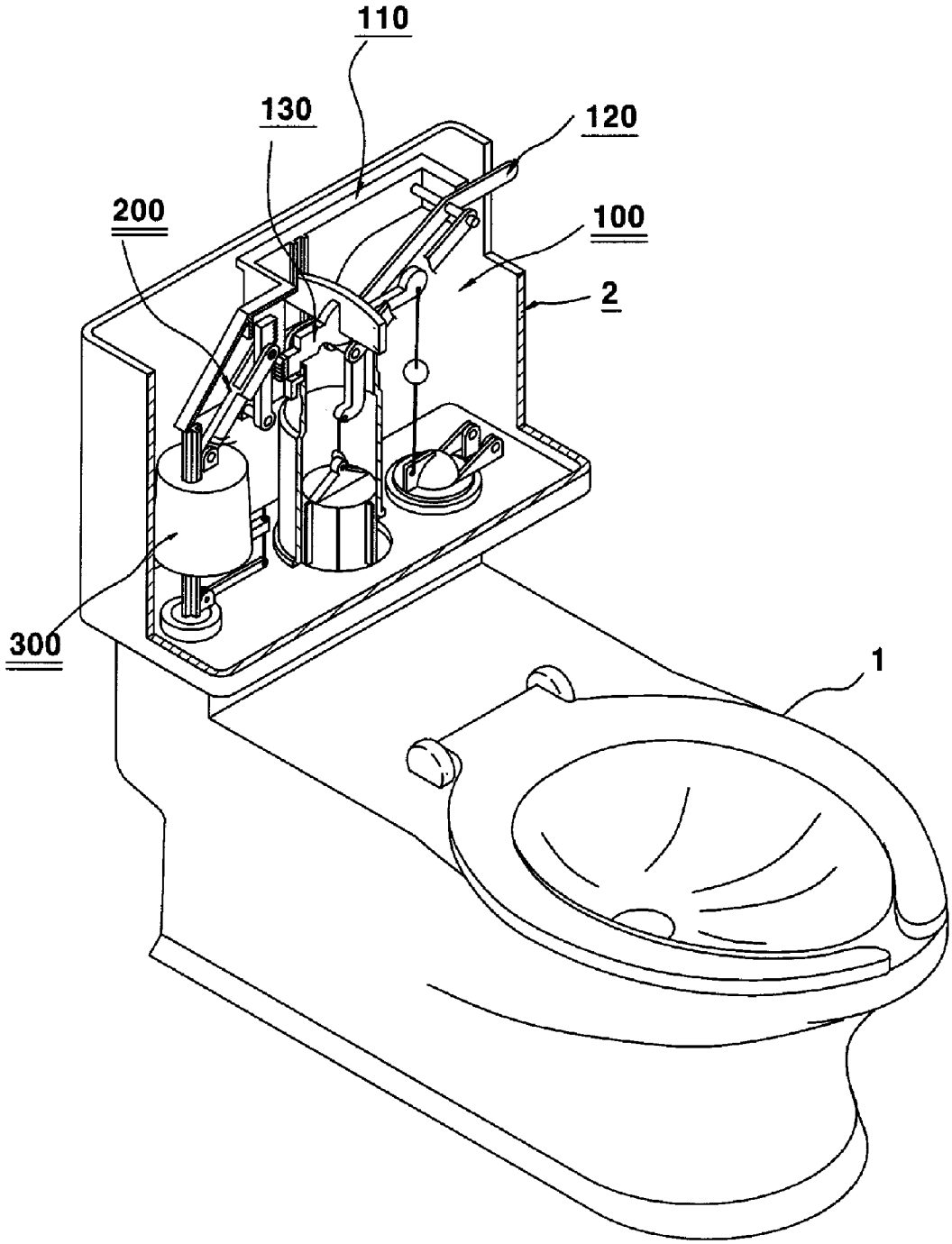

[Fig. 5]
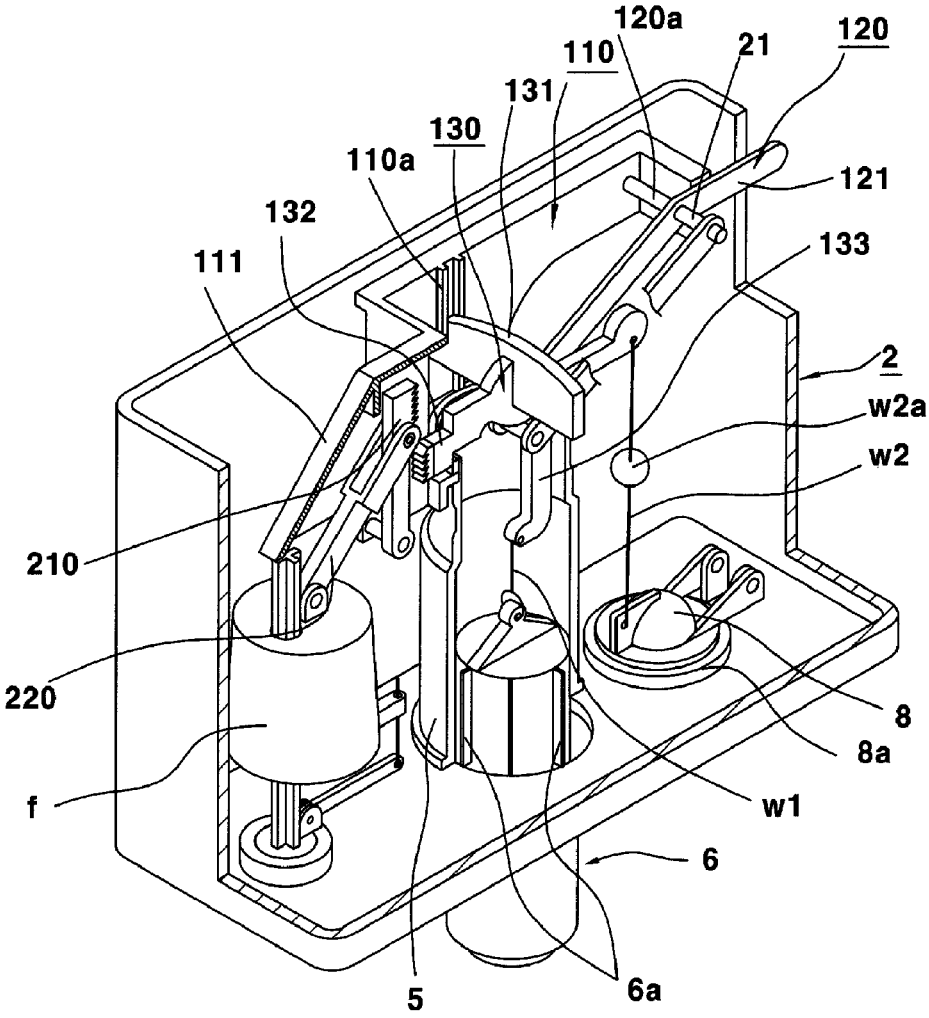

[Fig. 6]
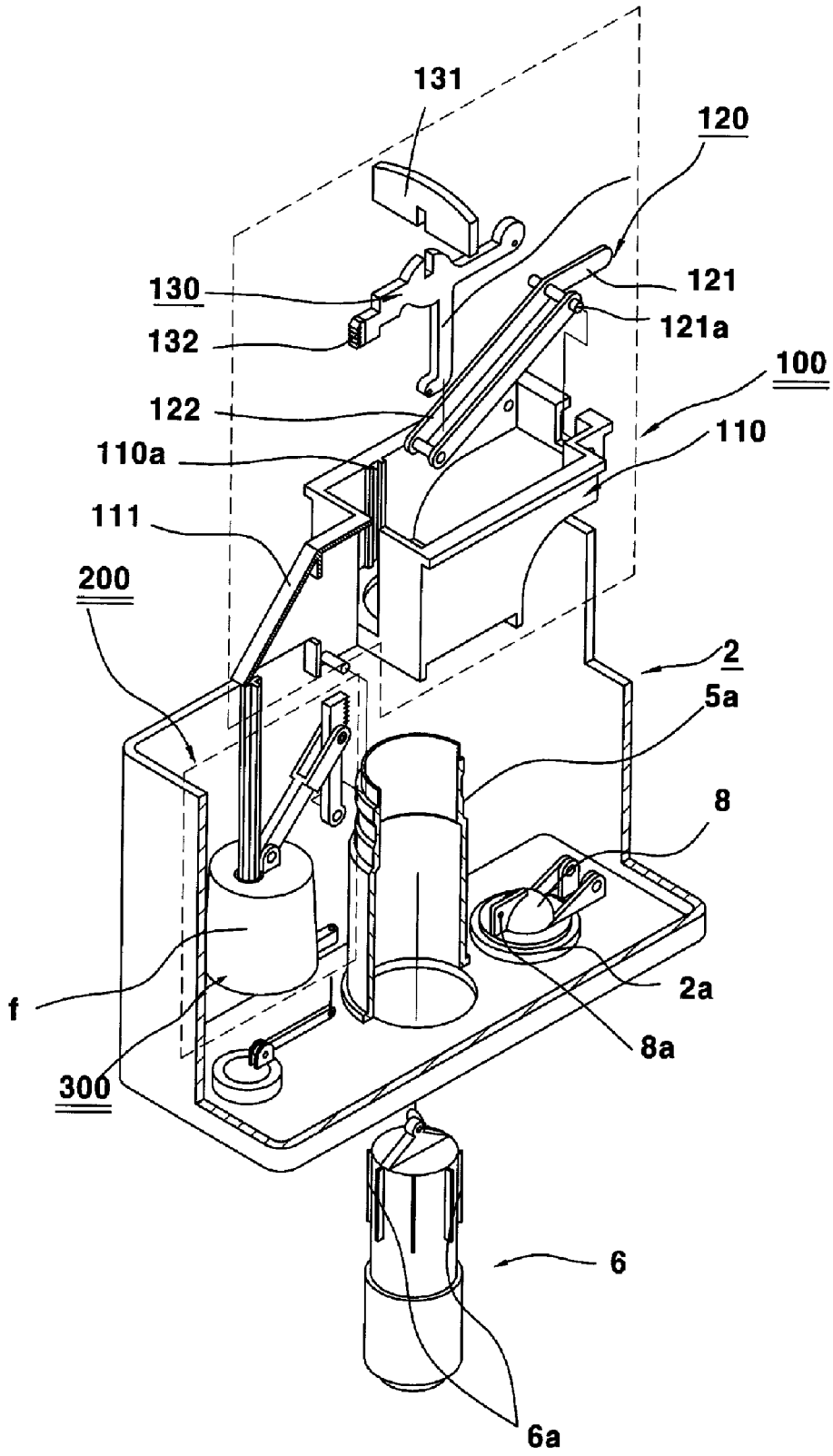

[Fig. 7]
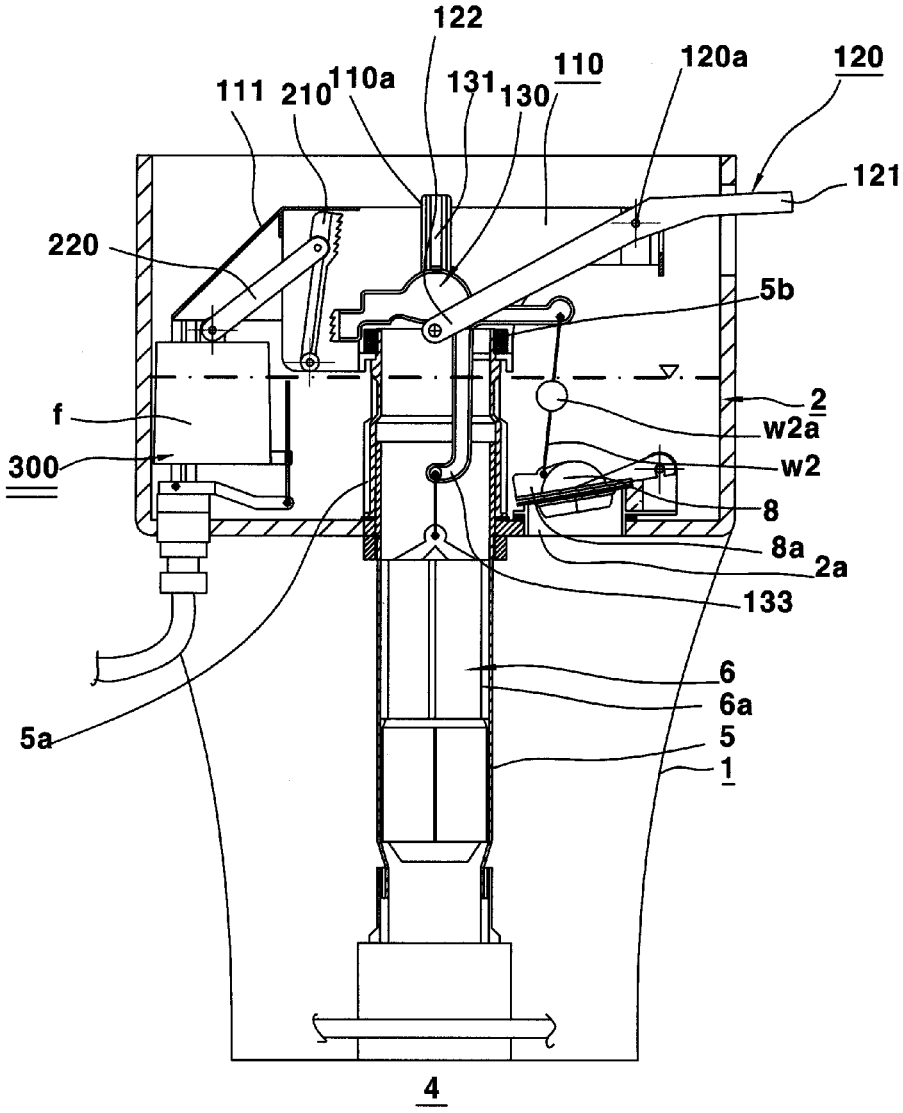

[Fig. 8]
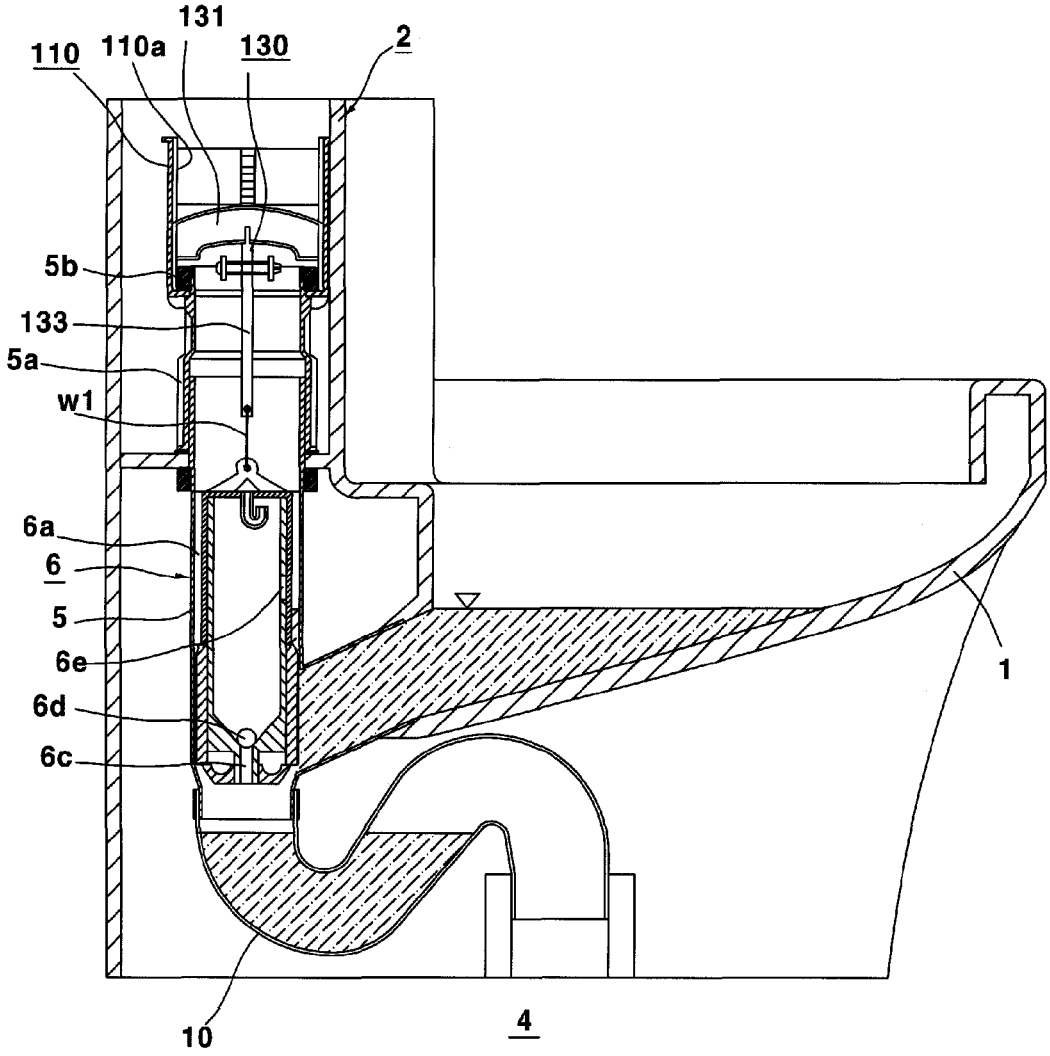

[Fig. 9]
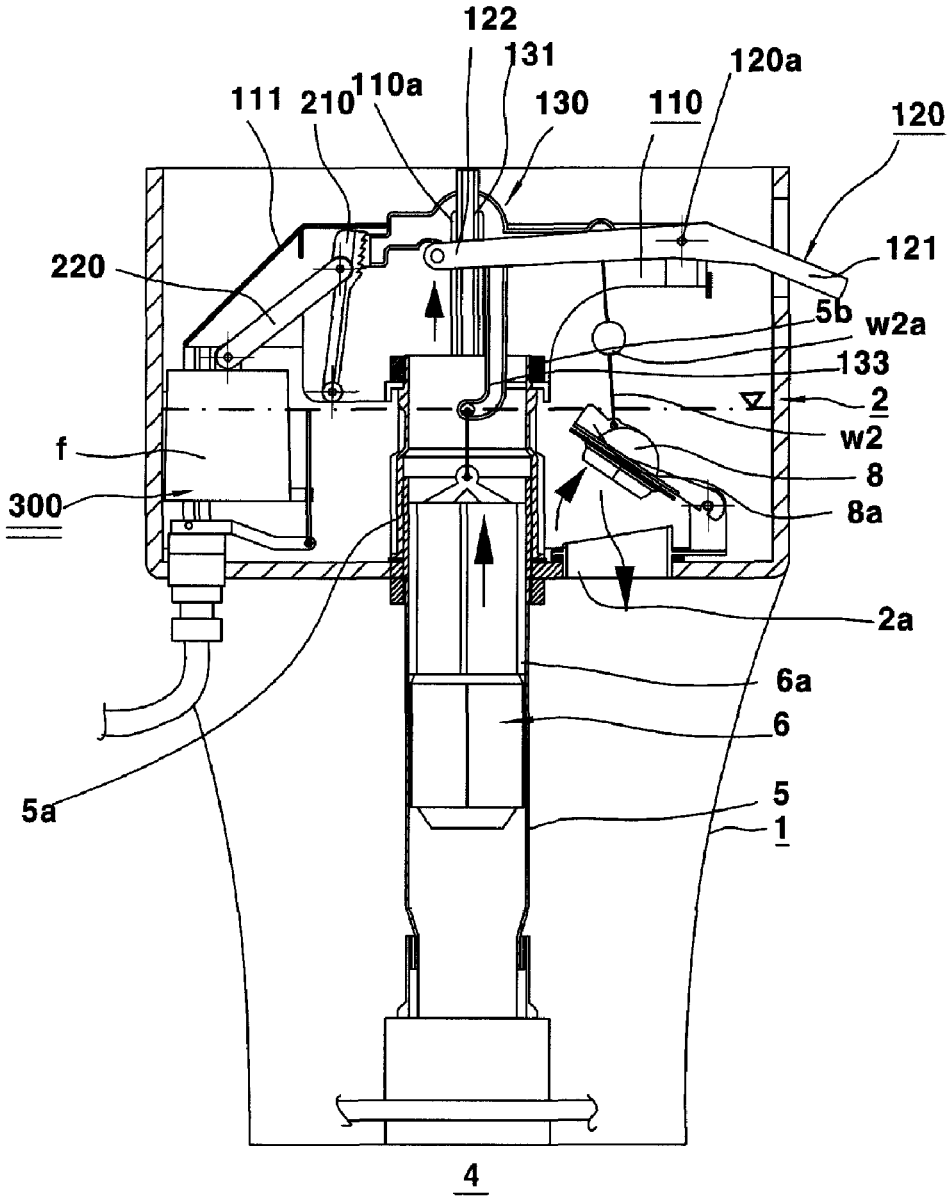

[Fig. 10]
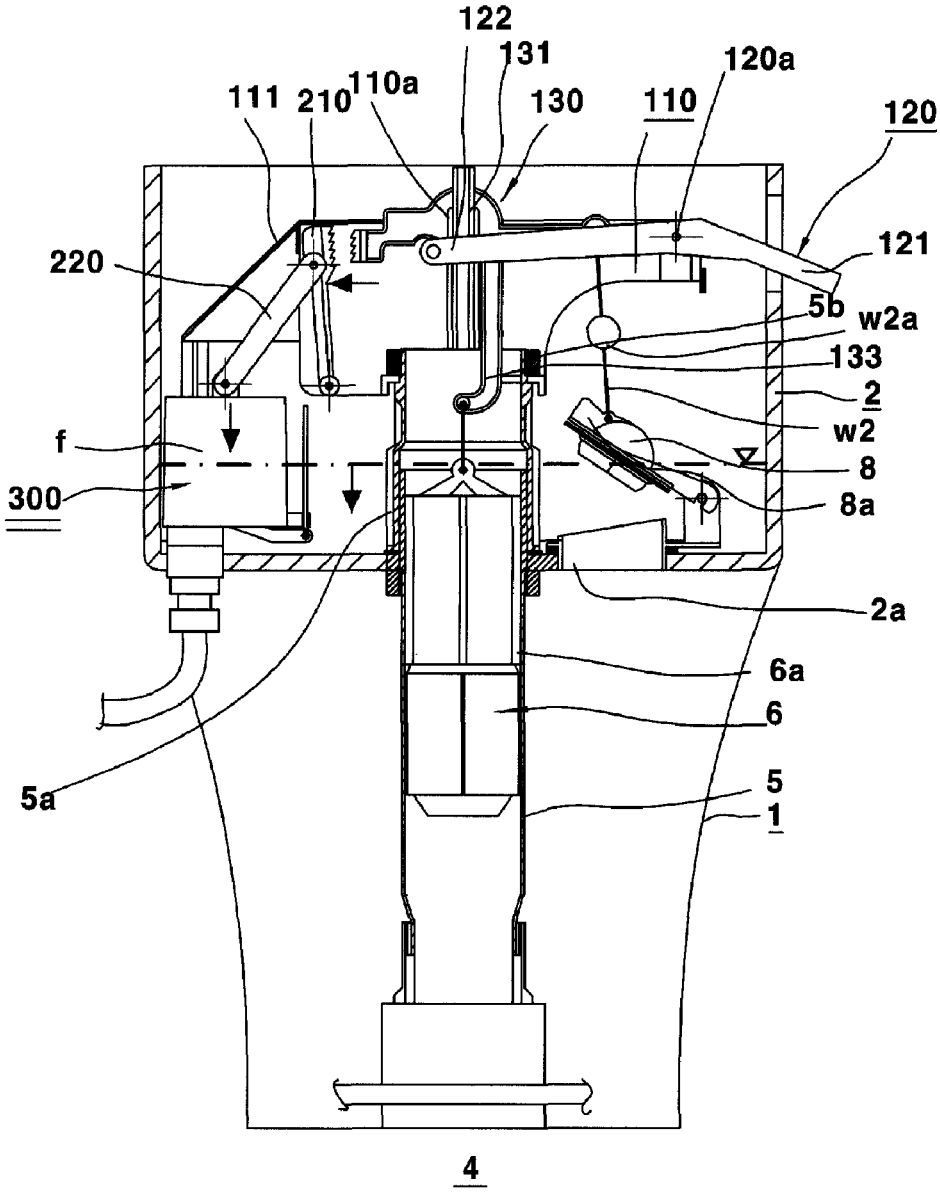

[Fig. 11]
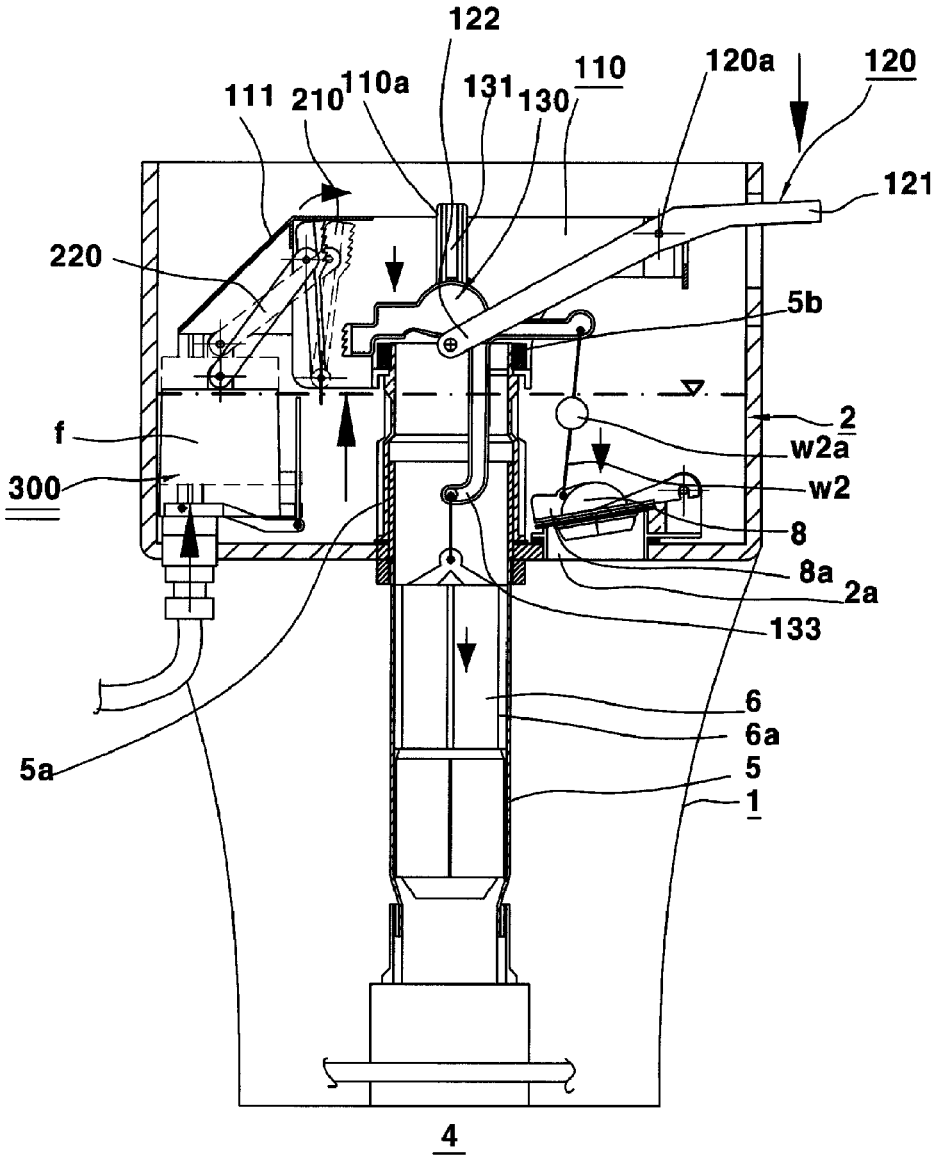

[Fig. 12]
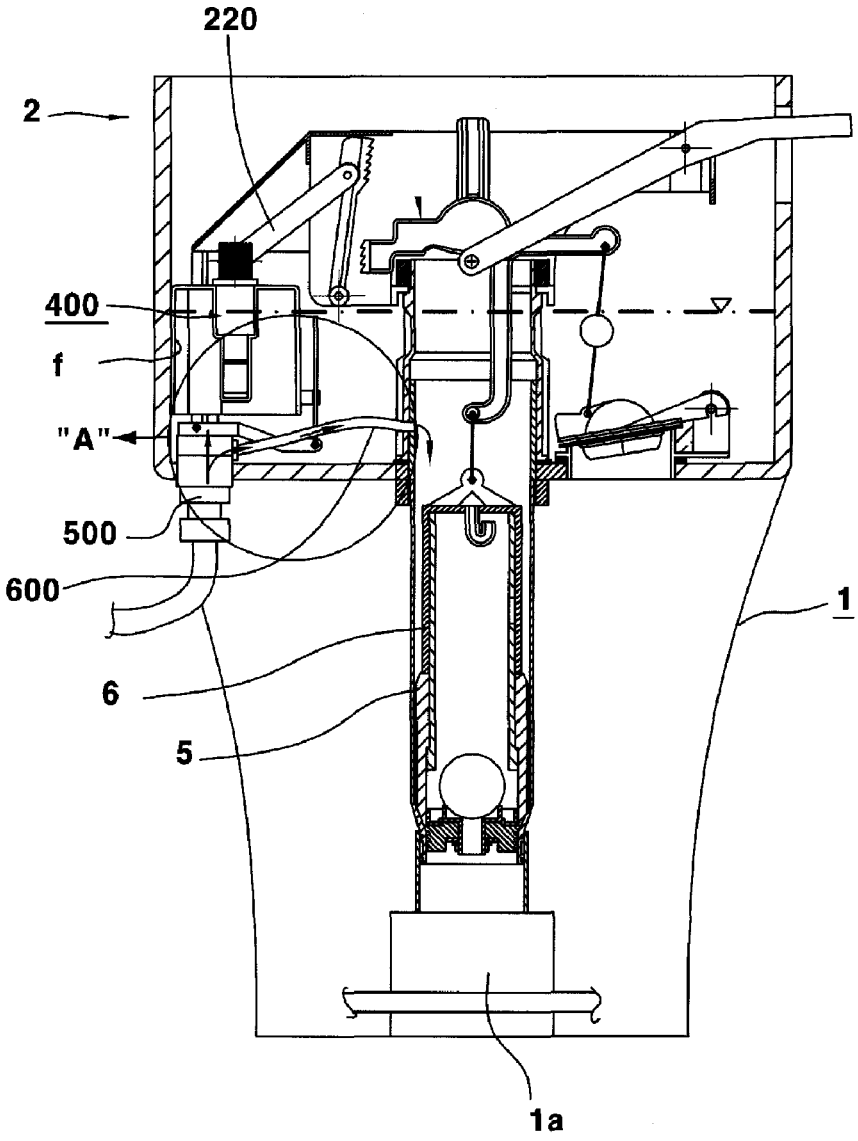

[Fig. 13]
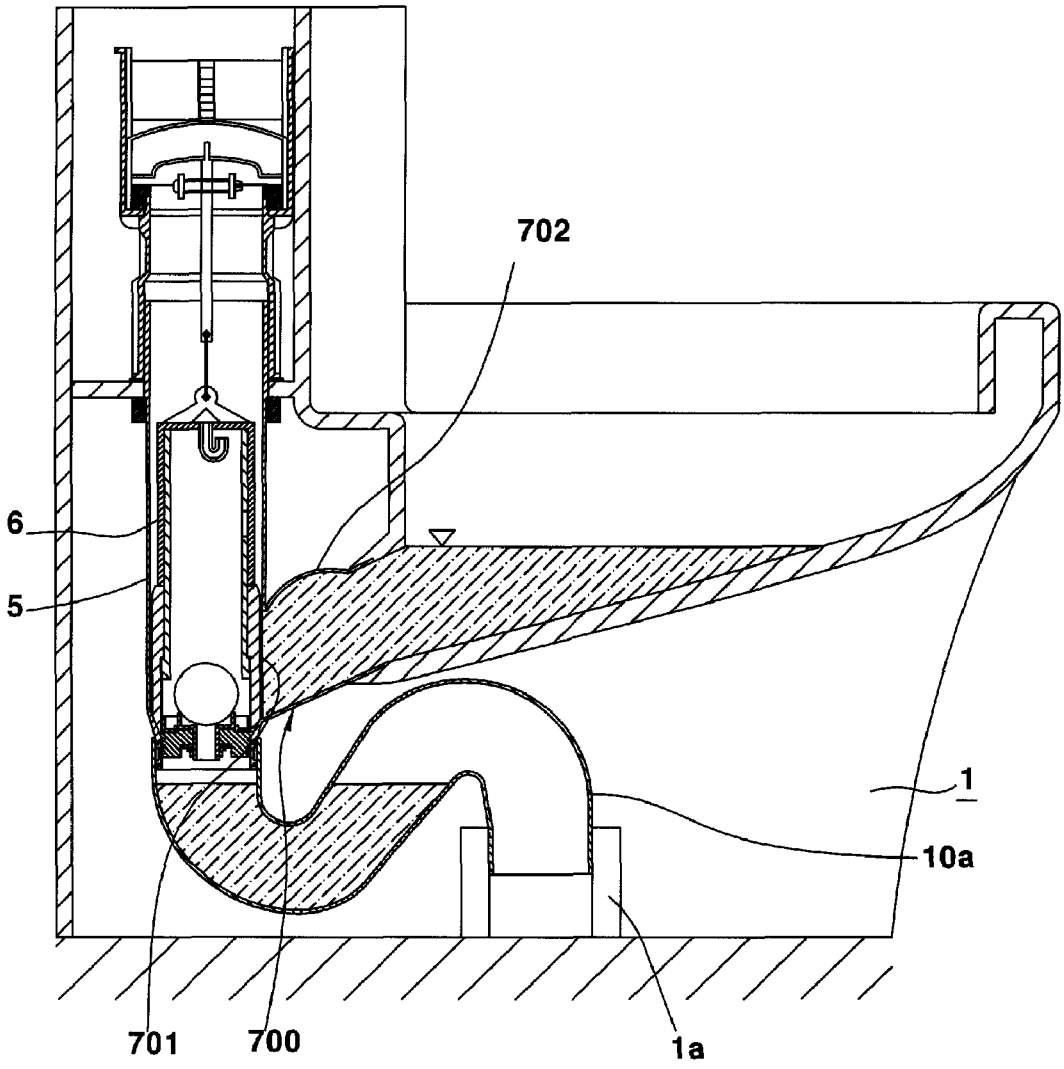

[Fig. 14]
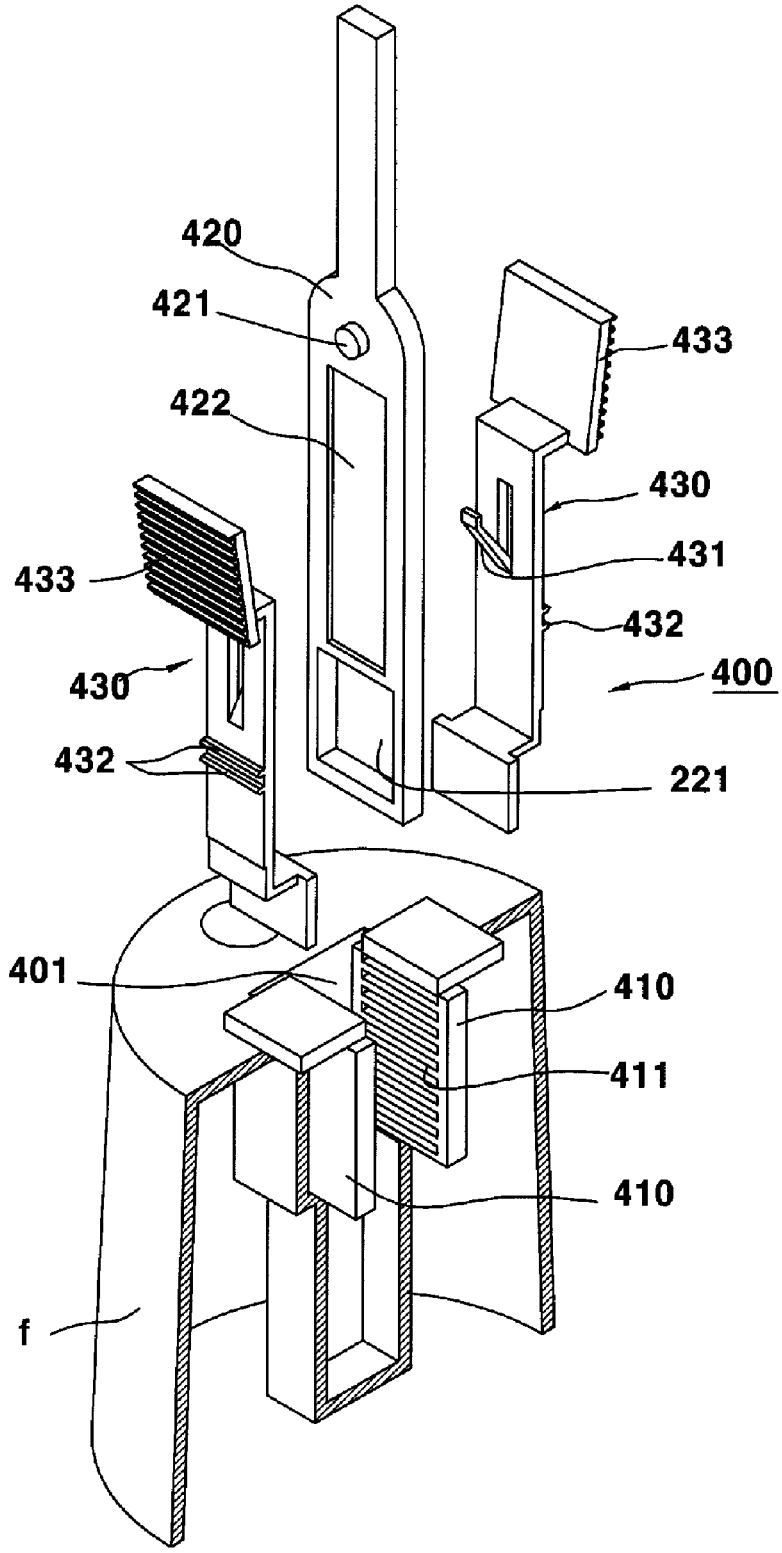

[Fig. 15]
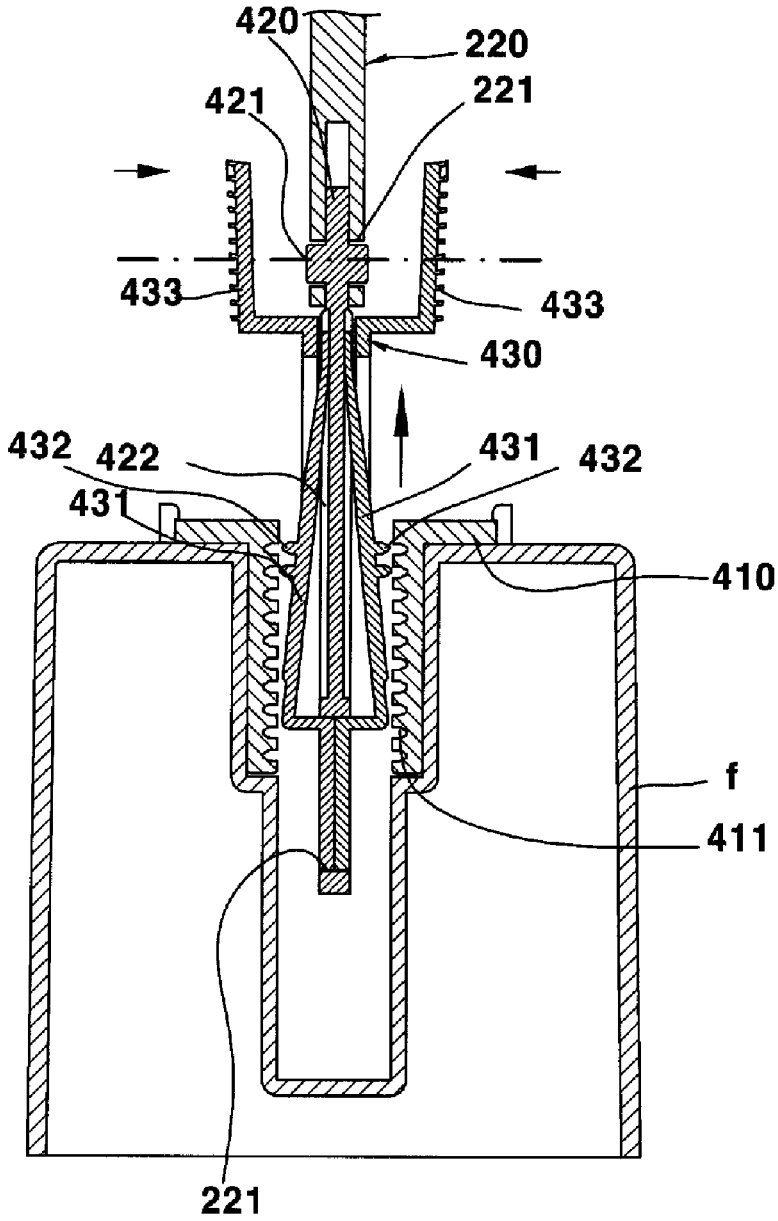

[Fig. 16]
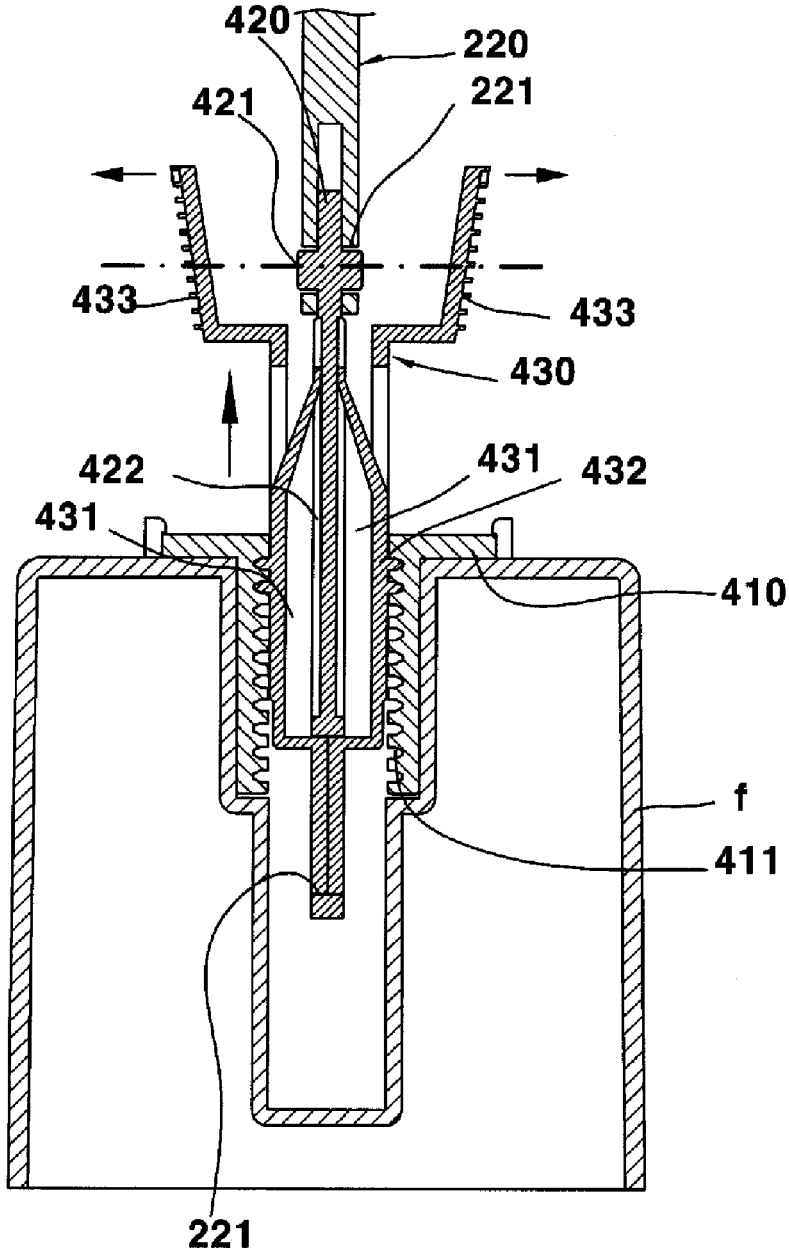

[Fig. 17]
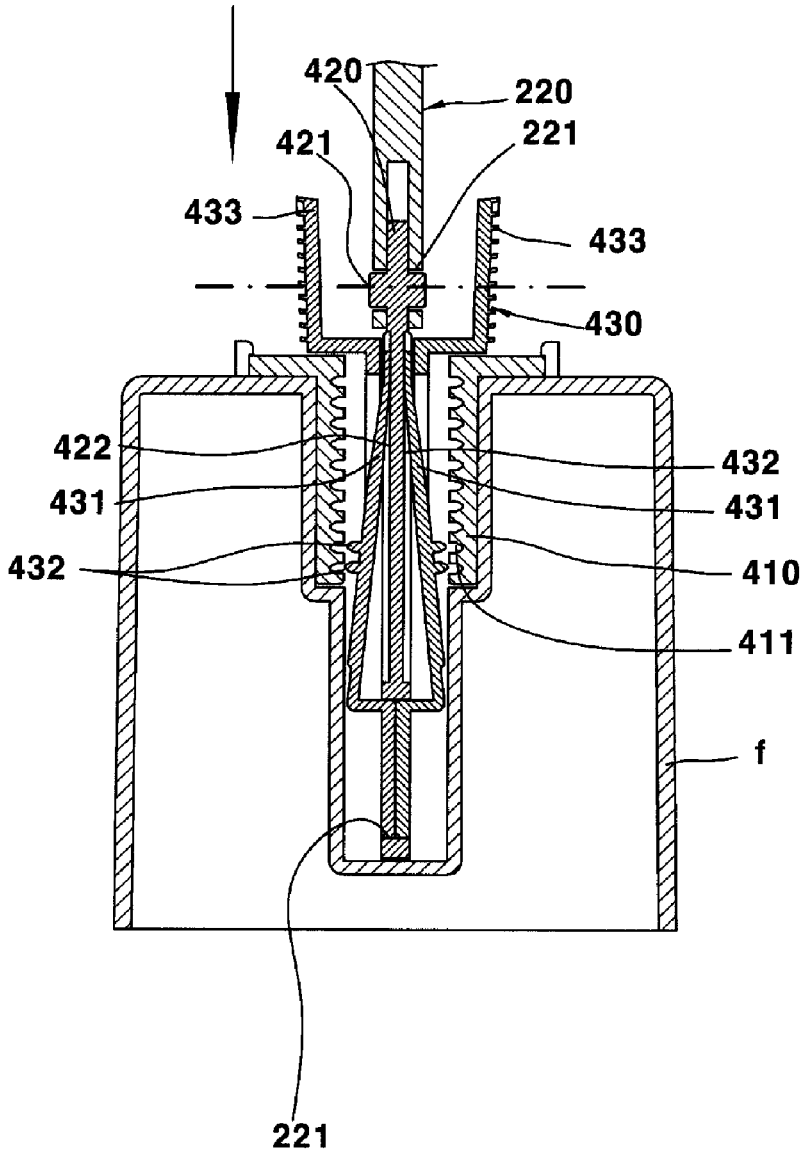

[Fig. 18]
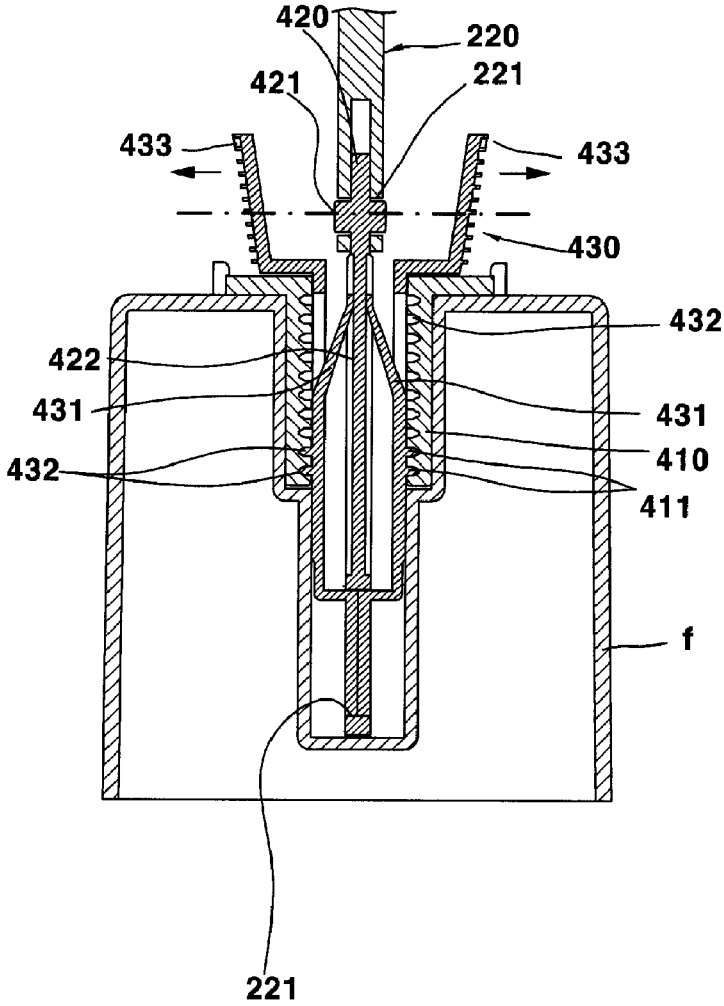
[Fig. 19]
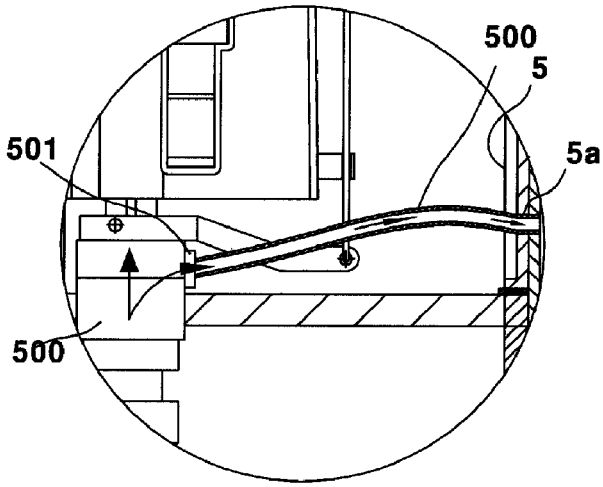

[Fig. 20]
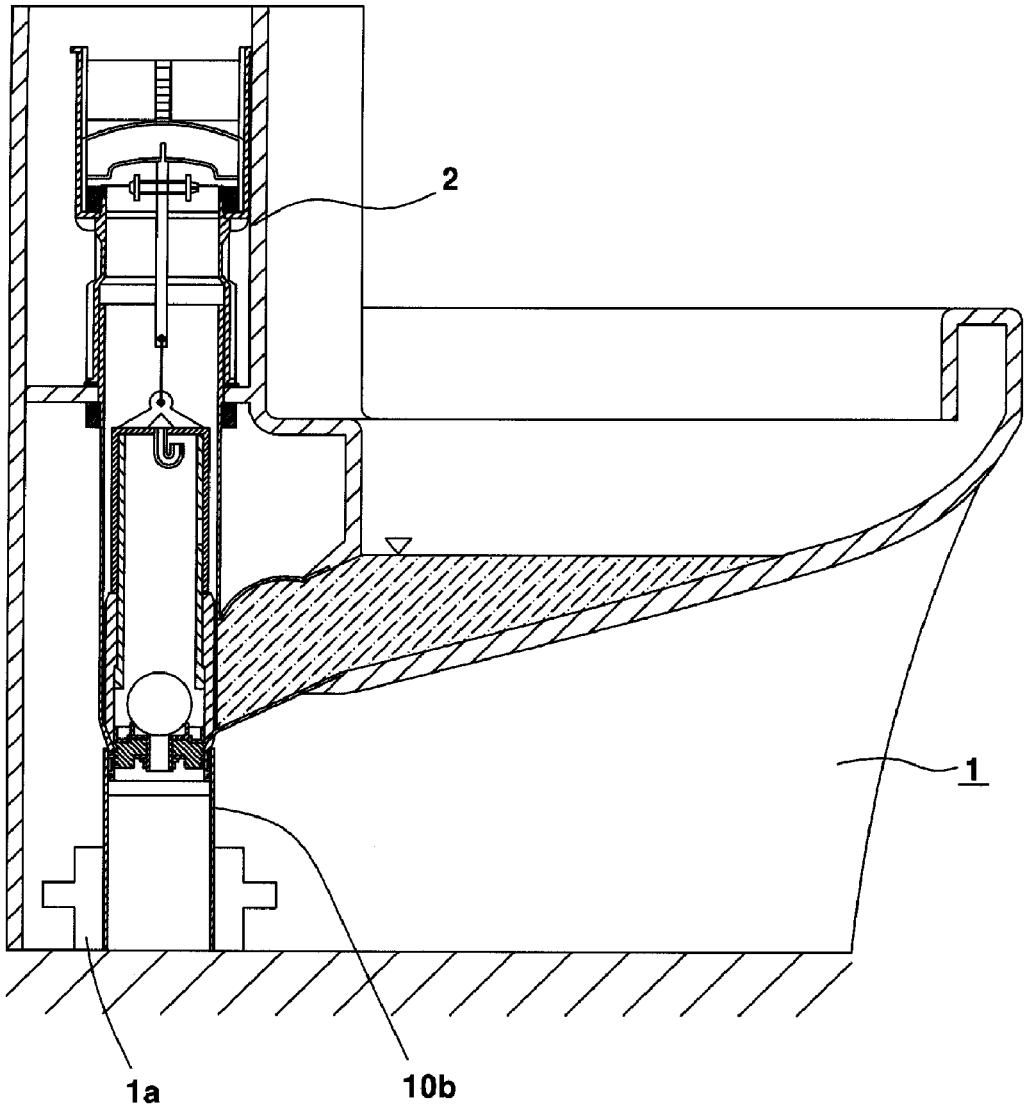

[Fig. 21]
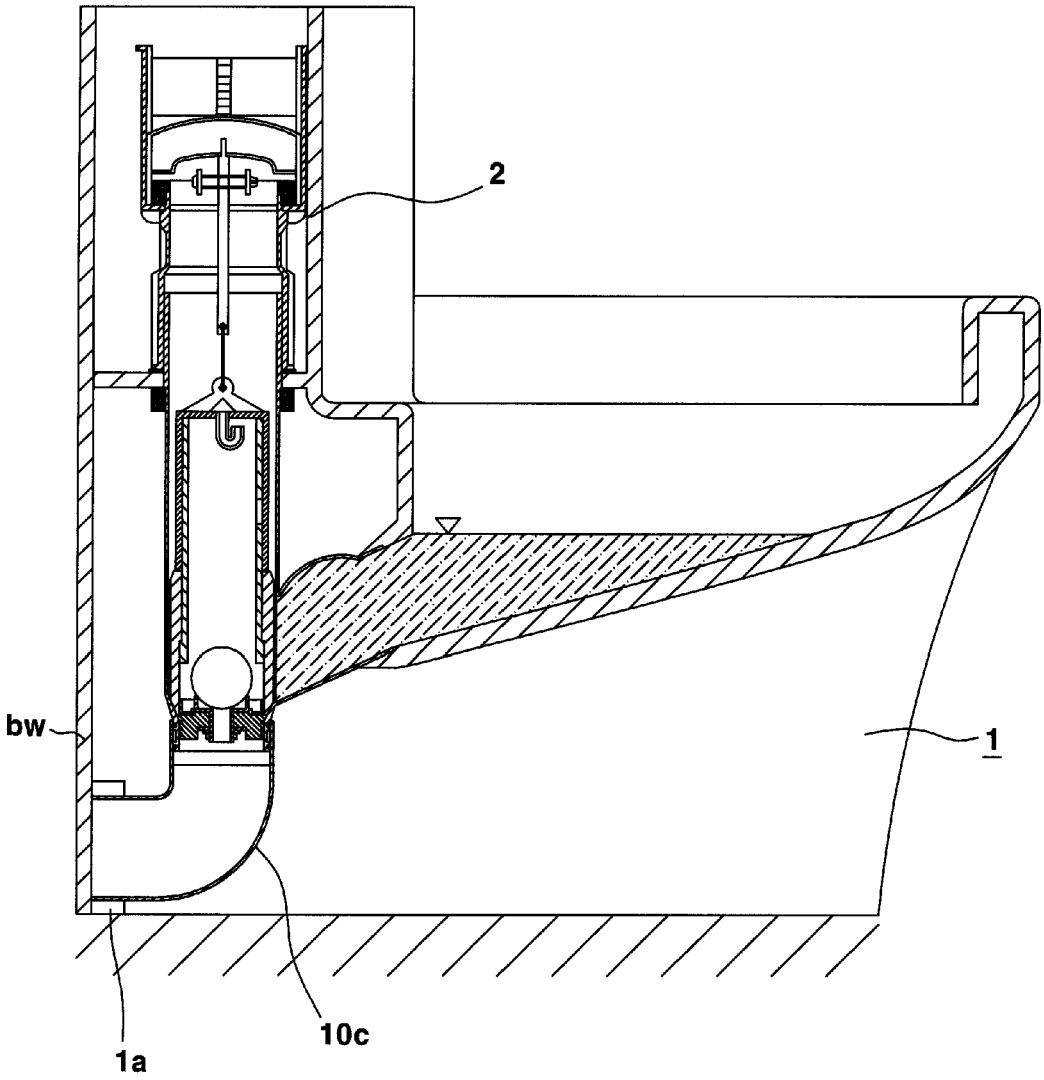

[Fig. 22]
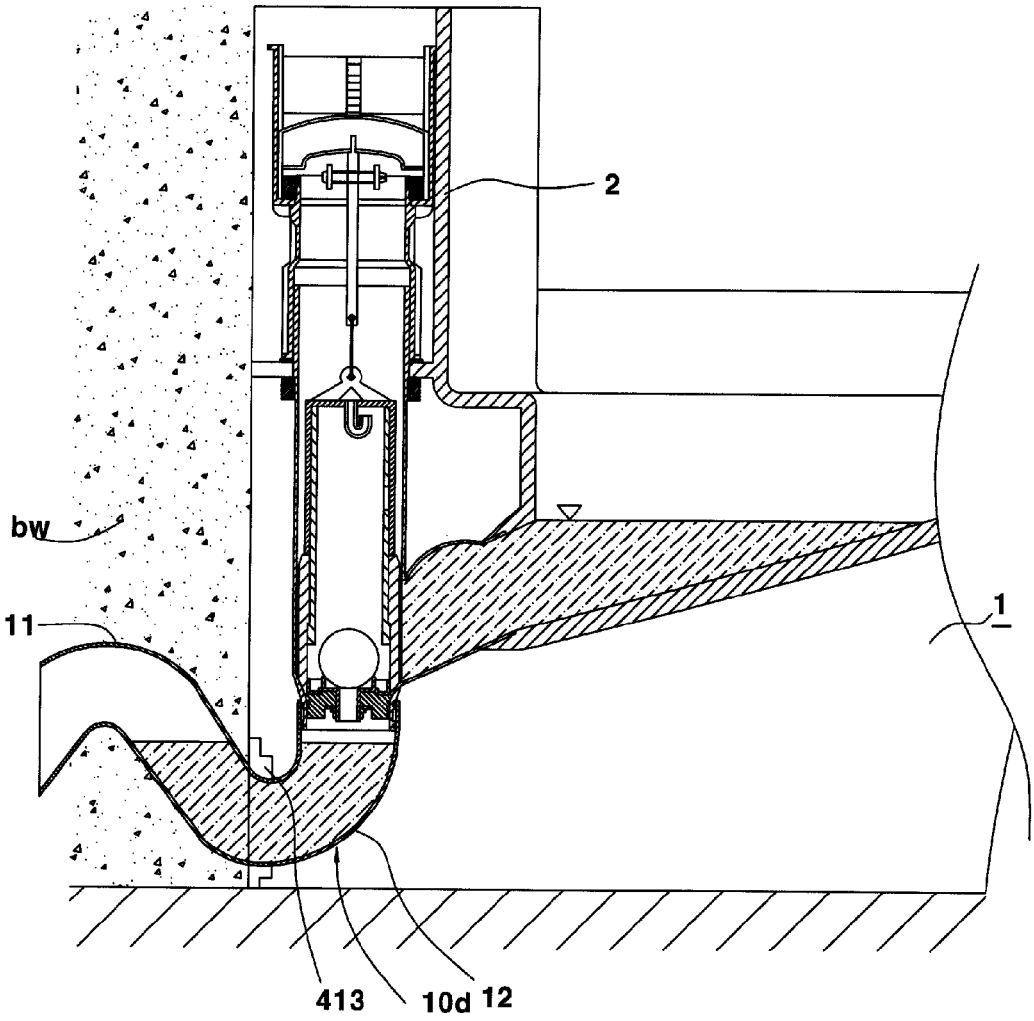

PASSIVELY DISCHARGING AND WATER-SAVING TOILET BOWL

TECHNICAL FIELD

The present invention relates to a water-saving toilet bowl capable of discharging stools passively by taking advantage of gravity. More particularly, the present invention relates to a passively discharging and water-saving toilet bowl having an operation mechanism in which all parts are accurately operated as well as a water supply controlling mechanism by which the water level in a water reservoir can be controlled arbitrarily.

BACKGROUND ART

As well known in the art, passively discharging and water-saving toilet bowls, which have been developed as alternatives to siphon-type toilet bowls, have no problems removing stool using half of the amount of water required by conventional toilet bowls based on the siphon principle. In addition, passively discharging and water-saving toilet bowls do not employ compulsory discharging manners but take advantage of gravity to remove the stool so as to generate no flushing noise. For this reason, they are attracting intensive attention as next-generation toilet bowls.

Such a passively discharging and water-saving toilet bowl, as seen in FIGS. 1 to 3, comprises a body 1 in which a slanted water drain path 1*a* is provided at the rear so as to induce the passive discharge of the stool; a water reservoir 2 for supplying water to the body; an operation unit 3, installed in the reservoir, for removing the stool a septic tank 4, installed underground, for storing the discharged stool; and a stool-discharging piston 6, provided within the stool discharging pipe 5 that communicates with the body and the septic tank and selectively opens the body and the septic tank.

The operation unit 3 includes a first link 3*a* which can rotate in a seesaw manner, is connected to a manipulation lever 7 and is supported to an internal wall of the water reservoir 2 at its one terminal portion, and a second link 3*b* which can rotate in a seesaw manner and is supported to an internal wall of the water reservoir 2, with its one terminal portion partially overlying the first link 3*a*. Because they are both connected to one end of the second link 3*b*, the stool-discharging piston 6 and a flap valve 8 move up and down according to the position of the end of the second link 3*b*.

However, such a conventional water-saving toilet bowl has a critical drawback of operating faultily. Although enjoying the advantages of flushing quietly and having low water consumption, the conventional water-saving toilet often shows inadequate operation such that water overflows the body 1 upon flushing, or the stool is not discharged.

Fundamentally, these problems with the basic functionality are based on a subsidiary water tank 9. When the second link 3*b* is slanted downwards, the subsidiary water tank 9 has to function to maintain the slanted state for a predetermined time. In most cases of operational problems, the subsidiary water tank 9 does not perform this function, so that the second link does not remain in the slanted state for a sufficient amount of time, but returns back to the original state.

Accordingly, the stool-discharging piston 6 closes in advance of complete removal of the stool. In the meantime, while the flap valve 8 is caused to remain open by buoyancy, the stool-discharging pipe is closed. In this condition, water is continuously supplied from the reservoir to the inside of the body 1 upon flushing, so that overflow occurs.

Additionally, the subsidiary water tank 9 is not smoothly moved downwards upon flushing because of the resistance of the buoyancy exerted thereto. Hence, the manipulation lever 7 with which the subsidiary water tank 9 is forcibly moved down is not smoothly operated.

Through a wire W, the second link 3*b* is connected both to the stool-discharging piston 6 and to the flap valve 8. Since the wire W is at a slanted angle with respect to the direction of the force of the manipulation lever upon flushing, a larger force is needed than that required when it is in line with the direction. Thus, more force must be applied to the manipulation lever 7, reducing the lifespan of the parts used and the reliability of their operation.

DISCLOSURE

Technical Problem

Accordingly, the present invention has been made keeping in mind the above problems occurring in the prior art, and an object of the present invention is to provide a passively discharging and water-saving toilet bowl having an operation mechanism in which all parts are accurately operated.

Another object of the present invention is to provide a passively discharging and water-saving toilet bowl provided with a water supply controlling mechanism by which the water level in a water reservoir can be controlled arbitrarily.

A further object of the present invention is to provide a passively discharging and water-saving toilet bowl which is structured to always have water remaining in a connection pipe, thereby preventing the countercurrent of bad odors from the septic tank.

Yet another object of the present invention is provide a passively discharging and water-saving toilet bowl which allows pipe laying for the stool-discharging pipes to be conducted in various places such as the floor or wall, so that it may be easily adapted to many locations.

Technical Solution

In order to accomplish the above objects, the present invention provides a passively discharging and water-saving toilet bowl, having an operation mechanism conducted with an operation unit comprising: a first operation unit, operated with a manipulation lever, communicating both with a stool-discharging piston for opening or closing a stool-discharging pipe and with a flap valve for opening or closing a water reservoir; and a second operation unit, operating in response to the position of a float for controlling the water level of the water reservoir in such a manner that the second operation unit is connected to and separated from the first operation unit when the float is situated at an upper position and a lower position, respectively.

In the toilet bowl, the first operation unit includes: a unit housing 110 fixed within the water reservoir; the manipulation lever, which is operated in a seesaw motion manner with a support of a seesaw point fixed within the unit housing and which is composed of a manipulation part, exposed externally, and an working part, located within the water reservoir; an elevation plate, which is installed within the unit housing to move up and down along a guide rail formed on an inner wall of the unit housing, is provided with a working latch at one end directed toward the second operation unit, and is connected at a bottom end and another end to the stool-discharging piston and the flap valve through respective wires which are in line with the respective directions of the motion of the stool-discharging piston and the flap valve upon flushing; and the second operation unit includes: a fixing latch, connected to the float through a link, which is engaged with the working latch upon flushing by the action of the manipulation lever and separated from the working latch when the water level descends to a predetermined point in the water reservoir.

Also, the present invention is characterized in that the stool-discharging pipe communicates with a septic tank through a connection pipe having a siphon shape.

Featuring the present invention, the connecting the elevation plate to the flap valve has a buoy thereon.

Also, the present invention is characterized in that the flap valve includes a wiring rib at a far end of the opening side thereof, to which the wire is bound.

In addition, the present invention further comprises a plurality of lengthwise shaking prevention ribs which are formed on the circumferential surface of the stool-discharging piston so as to be in contact with the inner circumferential surface of the stool discharging pipe.

In the passively discharging and water-saving toilet bowl, the float includes a level controller therein by which its level is controlled, said level controller comprising: a trench formed in an upper portion of the float; and a pair of locking plates, fixed in the trench to face each other, having locking grooves therein; a link fixture, located between the pair of the locking plates, the upper portion of which is hinged to a lower portion of the link; and a pair of level controlling plates, positioned between the respective locking plates and link fixture in such a way to face each other, each level controlling plate including an elastic piece, on the inner side, which elastically contacts the link fixture, a locking protrusion, on the outer side, which is locked into the locking holes, and a knob, at an upper portion, which serves to separate the locking protrusion from the locking grooves, and being combined at a lower portion with the link fixture.

Also, the present invention is characterized in that two bypass holes are respectively formed at positions on a water supply valve and the stool-discharging pipe so as to face each other, and communicates with each other through a tube.

Featuring the present invention, a slanted pipe is provided to communicate both with the body and the stool-discharging pipe and has an enlarged part which is swollen in a streamlined shape at an upper portion around its outlet.

In the passively discharging and water-saving toilet bowl, the connection pipe is established by previously installing a reverse U-shaped pipe in a back wall and then joining a U-shaped pipe to the reverse U-shaped pipe so as to form a siphon shape.

ADVANTAGEOUS EFFECTS

According to the present invention, the passively discharging and water-saving toilet bowl can accurately operate the stool-discharging piston and the flap valve upon flushing, thereby discharging the stools readily without water overflowing from the toilet bowl body.

Additionally, because there are no parts that are subject to the large resistance of buoyancy as in conventional toilet bowls, related parts used in the present invention are not strained and have longer lifespan than do those used in the conventional toilet bowls.

Further, the toilet bowl of the present invention is structured to always have water remaining in the connection pipe, so that is does not leak bad odors from the septic tank.

Furthermore, pipe laying for the stool-discharging pipes can be conducted in various places such as the floor or wall, so that the passively discharging and water-saving toilet bowl of the present invention may be easily adapted to many locations.

DESCRIPTION OF DRAWINGS

FIG. 4 is a perspective view showing the assembled structure of a passively discharging and water-saving toilet bowl according to an embodiment of the present invention;

FIG. 5 is an enlarged perspective view showing the assembled structure of the passively discharging and water-saving toilet bowl according to an embodiment of the present invention;

FIG. 6 is an exploded perspective view showing the structure of the passively discharging and water-saving toilet bowl according to an embodiment of the present invention;

FIG. 7 is a front cross sectional view showing the operation mechanism of the passively discharging and water-saving toilet bowl according to an embodiment of the present invention before flushing or after the completion of flushing;

FIG. 8 is a side cross sectional view of FIG. 7;

FIG. 9 is a front cross sectional view showing the engagement of a working latch with a fixing latch according to the operation of a manipulation lever for flushing;

FIG. 10 is a front cross sectional view showing the separation of the working latch from the fixing latch according to a decrease in water level;

FIG. 11 is a front cross sectional view showing the operation mechanism set back to the original state as water is supplied to a reservoir;

FIG. 12 is a front cross sectional view showing the structure of a passively discharging and water-saving toilet bowl according to another embodiment of the present invention;

FIG. 13 is a side cross sectional view of FIG. 12;

FIG. 14 is an exploded perspective view showing a level controller;

FIG. 15 is an assembled cross sectional view of the level controller, showing the manipulation of lowering the position of a float;

FIG. 16 is an assembled cross sectional view of the level controller after the position of the float is lowered;

FIG. 17 is an assembled cross sectional view of the level controller, showing the manipulation of lifting up the position of the float;

FIG. 18 is an assembled cross sectional view showing the level controller after the position of the float is lifted;

FIG. 19 is an enlarged view of portion A of FIG. 12;

FIG. 20 is a view showing an example of pipe laying according to the present invention;

FIG. 21 is a view showing another example of pipe laying according to the present invention; and FIG. 22 is a view showing a further example of pipe laying according to the present invention.

BEST MODE

Figure 1:
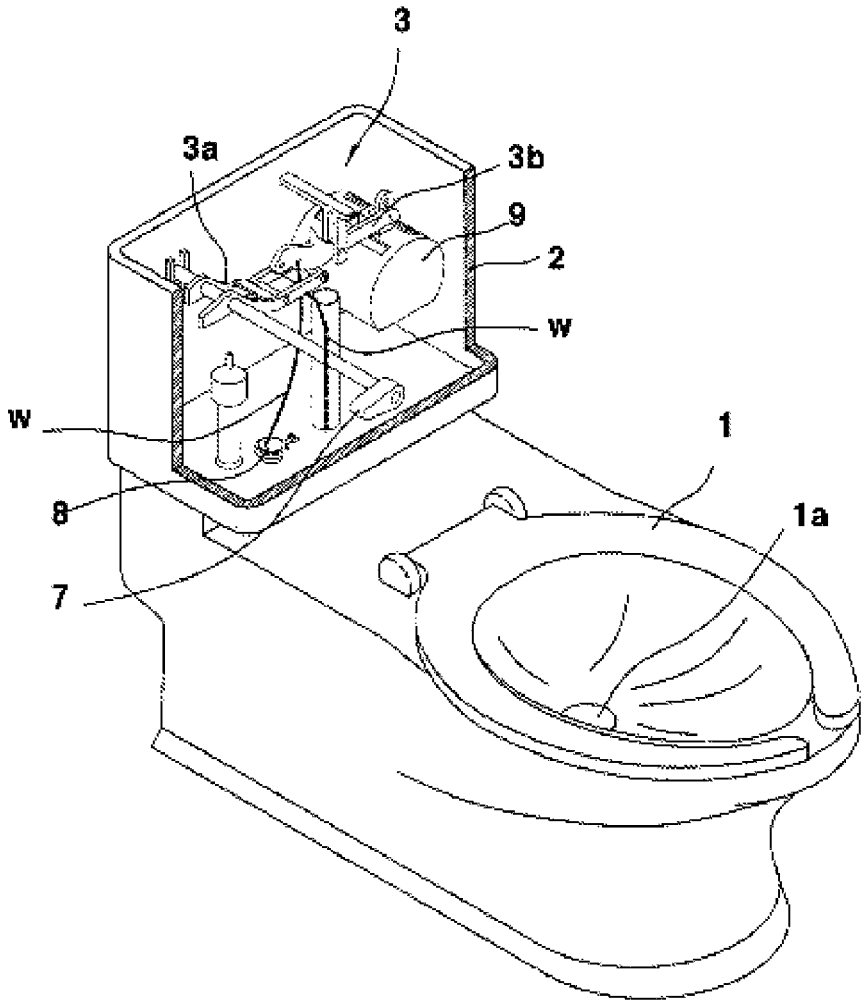
FIG. 1 is a perspective view showing the assembled structure of a conventional passively discharging and water-saving toilet bowl.
Figure 2:
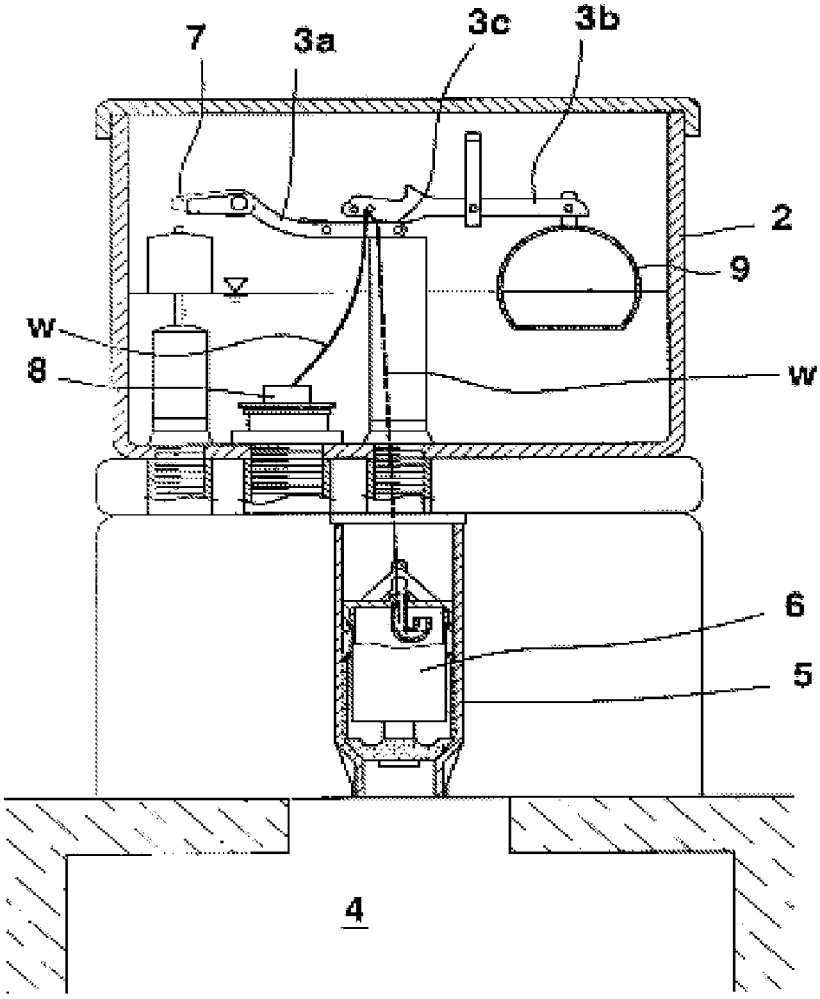
FIG. 2 is a front cross sectional view showing the operation mechanism of a conventional passively discharging and water-saving toilet bowl before flushing or after the completion of flushing.
Figure 3:
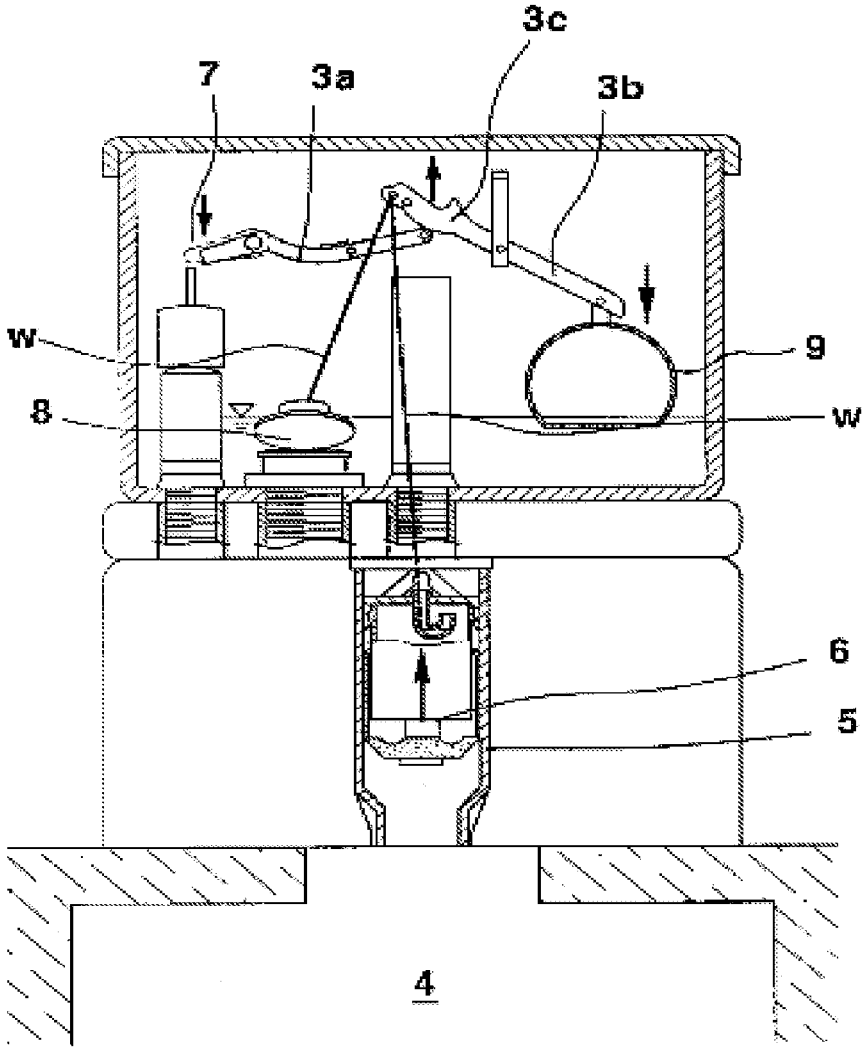
FIG. 3 is a front cross sectional view showing the operation mechanism of a conventional passively discharging and water-saving toilet bowl during flushing.

Below, a detailed description will be given of the preferred embodiments of the present invention, with reference to FIGS. 4 to 22.

FIG. 5 is an enlarged perspective view showing the assembled structure of the passively discharging and water-saving toilet bowl according to an embodiment of the present invention. FIG. 6 is an exploded perspective view showing the structure of the passively discharging and water-saving toilet bowl according to an embodiment of the present invention. FIG. 7 is a front cross sectional view showing the operation mechanism of the passively discharging and water-saving toilet bowl according to an embodiment of the present invention before flushing or after the completion of flushing. FIG. 8 is a side cross sectional view of FIG. 7. FIG. 9 is a front cross sectional view showing the engagement of a working latch with a fixing latch according to the operation of a manipulation lever for flushing. FIG. 10 is a front cross sectional view showing the separation of the working latch from the fixing latch according to a decrease in water level. FIG. 11 is a front cross sectional view showing the operation mechanism set back to the original state as water is supplied to a reservoir. FIG. 12 is a front cross sectional view showing the structure of a passively discharging and water-saving toilet bowl according to another embodiment of the present invention. FIG. 13 is a side cross sectional view of FIG. 12. FIG. 14 is an exploded perspective view showing a level controller. FIG. 15 is an assembled cross sectional view of the level controller, showing the manipulation of lowering the position of a float. FIG. 16 is an assembled cross sectional view of the level controller after the position of the float is lowered. FIG. 17 is an assembled cross sectional view of the level controller, showing the manipulation of lifting up the position of the float. FIG. 18 is an assembled cross sectional view showing the level controller after the position of the float is lifted. FIG. 19 is an enlarged view of portion A of FIG. 12. FIG. 20 is a view showing an example of pipe laying according to the present invention. FIG. 21 is a view showing another example of pipe laying according to the present invention. FIG. 22 is a view showing a further example of pipe laying according to the present invention.

As seen in FIGS. 4 to 11, the operation unit of the passively discharging and water-saving toilet bowl of the present invention, the operation of which is triggered through a manipulation lever 120, comprises a first operation unit 100 connected both with a stool-discharging piston 6 for opening or closing a stool-discharging pipe 5 and with a flap valve 8 for opening or closing a water reservoir 2; and a second operation unit 200 which is connected to the first operation unit 100 when a float f for controlling the water level of the water reservoir 2 is situated at an upper position, and is separated from the first operation unit when the float f is situated at a lower position.

The first operation unit 100 including a unit housing 110 is fixed with a cap nut 5*b* on a support pipe 5*a* extending from the stool discharging pipe 5. The unit housing 110 is partially opened such that it communicates with the water reservoir 2. Also, the unit housing 110 is provided at its outside with a latch case 111 in which a fixing latch is installed, as described later.

Supported by a seesaw point 120*a* fixed within the unit housing 110, the manipulation lever 120, positioned at the side opposite the latch case 11, is operated in a seesaw motion manner. The manipulation lever 120 comprises a manipulation part 121, exposed externally, on which an external force is exerted upon flushing, and a working part 122, located within the water reservoir 2, for transferring the external force to other parts.

An elevation plate 130 is installed within the unit housing, with the bottom being in contact with the working part 122. The elevation plate 130 moves up and down according to the movement of the manipulation lever 120. Provided crosswise on the elevation plate 130, a guide plate 131 is combined with a guiding rail formed in a vertical direction on an inner wall of the unit housing 110. The elevation plate 130 and the guide plate 131 may be formed integrally with or separately from each other.

At one end, directed toward the second operation unit 200, the elevation plate 130 is provided with a working latch 132. Directed toward a central portion of the stool-discharging piston 6, a hook 133 integrally extends from a middle portion of the elevation plate 130. The connection between the hook and the stool-discharging piston is achieved by a wire W1. Upon flushing, the wire W is in line with the direction of the motion of the stool-discharging piston.

At the other end, directed away from the second operation unit 200, the elevation plate 130 is connected through a wire W2 to a flap valve 8 which serves to close and open a water port 2*a* of the water reservoir 2. Upon flushing, the wire W2 is in line with the direction of the motion of the flap valve.

The flap valve 8, which has a typical structure, comprises a wiring rib 8*a* for the wire W2, which is positioned at a far end of the opening side of the flap valve. In addition, provided with a buoy W2*a* thereon, the wire W2 can always be tightened. That is, the buoy W2*a* functions to prevent the wire W2 from becoming tangled.

The second operation unit 200 comprises a fixing latch 210 which has a latch at an upper internal portion, with the lower portion rotatably hinged at the inside of a latch case 111 provided at a side of the unit housing 110, and a link 220 which connects a float f to an upper portion of the fixing latch.

Upon flushing through the action of the manipulation lever 120, the fixing latch 210 is engaged with the working latch 132, whereas it is separated from the working latch when the water level descends to a predetermined point in the water reservoir 2.

The float f, as a part of a water supply unit 300, functions to interrupt the water supply unit so that supply water is not supplied into the water reservoir 2.

With a siphon shape, a connection pipe 10, which communicates the stool discharging pipe 5 with the septic tank 4, helps rapidly remove the stool from the body 1 using the siphon principle. In addition, the connection pipe 10 is structured to always have water remaining therein, thereby preventing bad odors from ascending from the septic tank 4 into the body.

Of course, the stool-discharging piston 6 can move smoothly and avoid uneven wear when it accurately maintains a vertical path without lateral motion. In consideration of this, a plurality of lengthwise shaking prevention ribs 6*a* is formed on the circumferential surface of the stool-discharging piston 6 so as to be in contact with the inner circumferential surface of the stool discharging pipe 5.

The stool-discharging piston 6 has an inner surface 6*b* which is inclined downwards at the bottom to form a funnel shape, with a water drain port 6*c* formed at the apex of the funnel. Located in the stool-discharging piston 6, a spherical valve 6*d* having a diameter larger than the water drain port 6*c* always plugs the water drain port 6*c* under normal conditions because the bottom of the inner surface 6*b* is inclined downwards. Thus, the spherical valve 6*d* functions to prevent the invasion of bad odor through the water drain port 6*c* from the septic tank 4.

Additionally, because it is made from a material having lower specific gravity than water, such as synthetic resin or rubber, the spherical valve 6*d* floats upon the introduction of water into the piston, so that the water drain port 6*c* is opened to drain the introduced water.

Further, an overflow hole 6*e* is formed on the wall of the piston at a position higher than the water level of the body 1, so as to drain any surplus inflowing water therethrough.

Following is the operation mechanism for the removal of stool upon flushing of the toilet bowl of the present invention.

Before the movement of the manipulation lever 120, the fixing latch 210 and the working latch 132, located at an upper and a lower position, respectively, are separated from each other. When the first operation unit of the manipulation lever 120 is moved downwards, the elevation plate 130 that rides on the lower part of the manipulation lever 120 ascends with the aid of the guide plate 131 and the guide rail 110*a* formed on the opposite sides of the water reservoir 2, in a seesaw motion.

Hence, the stool-discharging piston 6 and the flap valve 8 that are connected to the elevation plate 130 respectively through the wires W1 and W2 are simultaneously lifted to open the body 1 and the water reservoir 2. At the same time, the working latch 132 formed at one end of the elevation plate 130 rises to engage with the fixing latch 120.

Under this condition, the water of the water reservoir 2 is drained through the opened water port 2*a*, which gradually lowers the water level and thus makes the float f descend. Accordingly, the fixing latch 210 connected through the link 220 to the float f rotates anticlockwise on drawing to separate from the working latch 132 after the float has descended to some extent.

When separation happens between the working latch 132 and the fixing latch 210, the elevation plate 130 spontaneously descends due to its own weight, so that the stool-discharging piston 6 and the flap valve 9, connected through the wires W1 and W2 respectively, are closed.

At this time, the fixing latch 210 remains engaged with the working latch 132 until water is completely drained from the water reservoir 2. Therefore, the passively discharging and water-saving toilet bowl of the present invention overcomes the problem of the prior art that the stool-discharging piston 6 closes in advance of removal of sufficient water from the water reservoir.

When the float f is located at a lower position after water is drained from the water reservoir 2, the water supply unit 300 is opened so as to supply water into the water reservoir. The float f ascends due to its buoyancy with the rise of the water level, during which the link 220 connected to the float f is displaced to rotate the fixing latch 210 clockwise, as seen in FIG. 11, to some extent. As the rotation occurs, the fixing latch is ready to engage with the working latch 132, which is arising. After completion of this process, the operational mechanism is set back to the initial state as in FIG. 7.

As seen in FIGS. 12 to 22, the float f has a level controller 400 therein by which its level is controlled. The level controller 400 comprises a trench formed in an upper portion of the float f and a pair of facing locking plates 410, fixed in the trench, having locking grooves 411 thereon.

Between the pair of locking plates 410 is provided a link fixture 420, the upper portion of which is hinged to a lower portion of the link 220. As for the coupling structure between the link fixture 420 and the link 220, it is composed of two protrusions 421 which are formed on respective opposite sides of an upper portion of the link fixture, and holes 221 formed in lower portions of the link 220, with a loose juncture between the protrusions and the holes.

Also, the level controller comprises a pair of level controlling plates 430 that are positioned between the respective locking plates 410 and link fixture 420 in such a way as to face each other. Each of the level controlling plate 430 includes an elastic piece 431, on the inner side, which elastically contacts a guide surface 422 of the link fixture, a locking protrusion 432, on the outer side, which is locked into the locking holes 411, and a knob 433, in a upper portion, which serves to separate the locking protrusion from the locking grooves, and is combined at a lower portion with the link fixture 420. The combination of the link fixture 420 and the level controlling plates 430 can be achieved by inserting the lower portion of the level controlling plate 430, which is internally folded, into a coupling hole 423 formed in a lower portion of the link fixture 420.

Manipulation of the level controller 400 having the above-mentioned structure is illustrated in FIGS. 15 and 17. First, when both of the knobs 433 of the level controlling plates 430 are pressed toward each other, the elastic pieces 431 formed on the respective inner sides of the level controlling plates 430 are pressed against the link fixture 420 while the locking protrusion 432 formed on the respective outer sides of the level controlling plates 430 is separated from the locking hole 411. Under this condition, the level controller 400 is lifted up or lowered to a predetermined position, after which the removal of the pressure applied to the knobs 433 allows the elastic force of the elastic pieces 431 to push the level controlling plates to the locking plates 410, so that the locking protrusions of the level controlling plates are locked into the locking grooves of the locking plates. Because it is combined with the level controlling plates 430, the link fixture 420 is moved together, upon the motion of the level controlling plates.

According to the level of the level controlling plates and the link fixture 420, the position of the float f is determined. When the level controlling plates 430 and the link fixture 420 are moved upwards as seen in FIGS. 15 and 16, the highest position of the float f is lowered. By contrast, the downward dislocation of the level controlling plates 430 and the link fixture 420 allows the float f to reach a relatively high position. Accordingly, the stroke range of the float can be lengthened or shortened.

When the stroke range of the float f is shortened, the float has a low highest position which results in a small amount of the water being supplied to the water reservoir 2. On the other hand, a high stroke range of the float f raises the highest position, resulting in a large amount of the water in the water reservoir 2. The operation of a water supply valve 500 is well known in the art and its detailed description is omitted.

In the passively discharging and water-saving toilet bowl of the present invention, bypass holes 501 and 5*a* are formed at positions on the water supply valve 500 and the stool-discharging pipe 5, respectively, such that they face each other, and communicates with each other through a tube 600. Thus, part of the water supplied through the water supply valve is introduced through the tube 600 into the stool discharging pipe 5. This water passes through the stool discharging pipe 5 and comes to remain in the siphon-type connection pipe connected to a lower portion of the stool-discharging pipe 10, preventing bad odors from ascending from the septic tank 4.

In the passively discharging and water-saving toilet bowl, as seen in FIG. 13, a slanted pipe 700 is provided to communicate both with the body 1 and with the stool-discharging pipe 5 and has an enlarged part 702 which is swollen in a streamlined shape at an upper portion around its outlet 701. This structure helps discharge the stool from the slanted pipe 700 rapidly and smoothly without delay.

According to the position of the septic tank, the passively discharging and water-saving toilet bowl of the present invention may have pipes laid in the floor or the wall. In the case of laying pipes in the floor, the siphon-shaped connection pipe 10*a* is used, as seen in FIG. 13, when the stool outlet 1*a* is located at the center of the body 1 while a straight connection pipe is used, as seen in FIG. 20, when the stool outlet 1*a* is located directly above the stool discharging pipe 5.

On the other hand, in the case of laying pipes in the wall, an elbow connection pipe 10*c* may be used as seen in FIG. 21, or a siphon-shaped connection pipe 10*d* may be employed, which can be established by previously installing a reverse U-shaped pipe 11 in a back wall bw and then joining a U-shaped pipe 12 to the pipe 11 by use of a coupling 413. Accordingly, in spite of being installed in walls, the connection pipe may have a siphon shape so as to shield the countercurrent of offensive odor without causing problems discharging the stool.

INDUSTRIAL APPLICABILITY

As described above, the present invention provides a passively discharging and water-saving toilet bowl which can accurately operate the stool-discharging piston and the flap valve upon flushing, thereby discharging the stools readily without water overflowing from the toilet bowl body.

Additionally, there are no parts that are subject to the large resistance of buoyancy as in conventional toilet bowls, allowing the manipulation lever to be operated smoothly and thus, related parts are not strained. Accordingly, parts used in the present invention have longer lifespan than do those used in the conventional toilet bowls.

Further, the toilet bowl of the present invention does not leak bad odors from the septic tank, because it is constructed such that water always remains in the connection pipe.

Furthermore, pipe laying for the stool-discharging pipes can be conducted in various places such as the floor or wall, so that the passively discharging and water-saving toilet bowl of the present invention may be easily adapted to many locations.

The invention claimed is:

1. A passively discharging and water-saving toilet bowl, having an operation mechanism conducted with an operation unit comprising:

a first operation unit, operated with a manipulation lever, communicating both with a stool-discharging piston for opening or closing a stool-discharging pipe and with a flap valve for opening or closing a water reservoir; and a second operation unit, operating in response to the position of a float for controlling the water level of the water reservoir in such a manner that the second operation unit is connected to and separated from the first operation unit when the float is situated at an upper position and a lower position, respectively.

2. The passively discharging and water-saving toilet bowl according to claim 1, wherein the first operation unit includes:

a unit housing fixed within the water reservoir;

the manipulation lever, which is operated in a seesaw motion manner with a support of a seesaw point fixed within the unit housing and which is composed of a manipulation part, exposed externally, and an working part, located within the water reservoir;

an elevation plate, which is installed within the unit housing to move up and down along a guide rail formed on an inner wall of the unit housing, is provided with a working latch at one end directed toward the second operation unit, and is connected at a bottom end and another end to the stool-discharging piston and the flap valve through respective wires which are in line with the respective directions of the motion of the stool-discharging piston and the flap valve upon flushing; and the second operation unit includes:

a fixing latch, connected to the float through a link, which is engaged with the working latch upon flushing by the action of the manipulation lever and separated from the working latch when the water level descends to a predetermined point in the water reservoir.

3. The passively discharging and water-saving toilet bowl according to claim 1, wherein the stool-discharging pipe communicates with a septic tank through a connection pipe having a siphon shape.

4. The passively discharging and water-saving toilet bowl according to claim 1, wherein the wire connecting the elevation plate to the flap valve has a buoy thereon.

5. The passively discharging and water-saving toilet bowl according to claim 1, or wherein the flap valve includes a wiring rib at a far end of the opening side thereof, to which the wire is bound.

6. The passively discharging and water-saving toilet bowl according to claim 1, further comprising a plurality of lengthwise shaking prevention ribs which are formed on the circumferential surface of the stool-discharging piston so as to be in contact with the inner circumferential surface of the stool discharging pipe.

7. The passively discharging and water-saving toilet bowl according to claim 1, wherein the float includes a level controller therein by which its level is controlled, said level controller comprising:

a trench formed in an upper portion of the float; and a pair of locking plates, fixed in the trench to face each other, having locking grooves therein;

a link fixture, located between the pair of the locking plates, the upper portion of which is hinged to a lower portion of the link; and a pair of level controlling plates, positioned between the respective locking plates and link fixture in such a way to face each other, each level controlling plate including an elastic piece, on the inner side, which elastically contacts the link fixture, a locking protrusion, on the outer side, which is locked into the locking holes, and a knob, at an upper portion, which serves to separate the locking protrusion from the locking grooves, and being combined at a lower portion with the link fixture.

8. The passively discharging and water-saving toilet bowl according to claim 1, wherein two bypass holes are respectively formed at positions on a water supply valve and the stool-discharging pipe so as to face each other, and communicates with each other through a tube.

9. The passively discharging and water-saving toilet bowl according to claim 1, wherein a slanted pipe is provided to communicate both with the body and the stool-discharging pipe and has an enlarged part which is swollened in a streamlined shape at an upper portion around its outlet.

10. The passively discharging and water-saving toilet bowl according to claim 1, wherein the connection pipe is established by previously installing a reverse U-shaped pipe in a back wall and then joining a U-shaped pipe to the reverse U-shaped pipe so as to form a siphon shape.

11. The passively discharging and water-saving toilet bowl according to claim 2, wherein the stool-discharging pipe communicates with a septic tank through a connection pipe having a siphon shape.

12. The passively discharging and water-saving toilet bowl according to claim 2, wherein the wire connecting the elevation plate to the flap valve has a buoy thereon.

13. The passively discharging and water-saving toilet bowl according to claim 2, wherein the flap valve includes a wiring rib at a far end of the opening side thereof, to which the wire is bound.

14. The passively discharging and water-saving toilet bowl according to claim 2, further comprising a plurality of lengthwise shaking prevention ribs which are formed on the circumferential surface of the stool-discharging piston so as to be in contact with the inner circumferential surface of the stool discharging pipe.

15. The passively discharging and water-saving toilet bowl according to claim 2, wherein the float includes a level controller therein by which its level is controlled, said level controller comprising:

a trench formed in an upper portion of the float; and a pair of locking plates, fixed in the trench to face each other, having locking grooves therein;

a link fixture, located between the pair of the locking plates, the upper portion of which is hinged to a lower portion of the link; and a pair of level controlling plates, positioned between the respective locking plates and link fixture in such a way to face each other, each level controlling plate including an elastic piece, on the inner side, which elastically contacts the link fixture, a locking protrusion, on the outer side, which is locked into the locking holes, and a knob, at an upper portion, which serves to separate the locking protrusion from the locking grooves, and being combined at a lower portion with the link fixture.

16. The passively discharging and water-saving toilet bowl according to claim 2, wherein two bypass holes are respectively formed at positions on a water supply valve and the stool-discharging pipe so as to face each other, and communicates with each other through a tube.

17. The passively discharging and water-saving toilet bowl according to claim 2, wherein a slanted pipe is provided to communicate both with the body and the stool-discharging pipe and has an enlarged part which is swollened in a streamlined shape at an upper portion around its outlet.

18. The passively discharging and water-saving toilet bowl according to claim 2, wherein the connection pipe is established by previously installing a reverse U-shaped pipe in a back wall and then joining a U-shaped pipe to the reverse U-shaped pipe so as to form a siphon shape.

* * * * *